US009036850B2

(12) United States Patent
Larmour et al.

(10) Patent No.: US 9,036,850 B2
(45) Date of Patent: May 19, 2015

(54) AUGMENTED CUSTOM FIT HEADSET

(71) Applicant: Motorola Mobility LLC, Chicago, IL (US)

(72) Inventors: David W. Larmour, Suwanee, GA (US); Carl A. Cepress, Chicago, IL (US); Scott A. Wilke, Durand, IL (US); Mark D. Zaveson, Antioch, IL (US)

(73) Assignee: Google Technology Holdings LLC, Mountain View, CA (US)

( * ) Notice: Subject to any disclaimer, the term of this patent is extended or adjusted under 35 U.S.C. 154(b) by 0 days.

(21) Appl. No.: 14/278,029

(22) Filed: May 15, 2014

(65) Prior Publication Data

US 2014/0376764 A1 Dec. 25, 2014

Related U.S. Application Data

(60) Provisional application No. 61/836,765, filed on Jun. 19, 2013.

(51) Int. Cl.
*H04R 1/10* (2006.01)

(52) U.S. Cl.
CPC ..... *H04R 1/105* (2013.01)

(58) Field of Classification Search
CPC ..... H04R 1/10; H04R 1/105; H04R 5/0335; H04R 2201/10; H04R 2205/022
USPC ..... 381/370–371, 374, 376–379, 383
See application file for complete search history.

(56) References Cited

U.S. PATENT DOCUMENTS

| | | | | |
|---|---|---|---|---|
| 1,616,491 | A * | 2/1927 | Green | 381/377 |
| 1,713,206 | A * | 5/1929 | Young et al. | 381/377 |
| 2,681,389 | A * | 6/1954 | Shaper | 381/378 |
| 4,551,584 | A * | 11/1985 | Mathiasen | 381/377 |
| 5,406,037 | A * | 4/1995 | Nageno et al. | 381/377 |
| 7,702,122 | B2 | 4/2010 | Crutcher | |
| 8,116,477 | B2 | 2/2012 | Lee et al. | |
| 2007/0053539 | A1 * | 3/2007 | Tsunoda et al. | 381/377 |
| 2009/0022352 | A1 * | 1/2009 | Weibel | 381/378 |

FOREIGN PATENT DOCUMENTS

JP 10023586 A 1/1998

OTHER PUBLICATIONS

Philips O'Neill SH09565BK/28 The Stretch Headband Headset (Black), http://www.amazon.com.Philips-SHO9565BK-28-STRETCH-Headband/dp/B005623412, Feb. 4, 2013, all pages.*

(Continued)

*Primary Examiner* — Suhan Ni

(57) ABSTRACT

An augmented custom fit headset (300) is disclosed. The augmented headset (300) can include: a wearable module (310) configured to be worn around a user's head including an outer band structure (312) with left and right ends (314) and (316), at least one of the left and right ends (314) and (316) having an inner facing cavity (318); earpiece modules (322) and (324) including left and right speakers (326) and (328) connected to the left and right ends (314) and (316); and a removable inner band (330) including a plug portion (332), the plug portion (332) being snap connected to the inner facing cavity (318), defining a snap connector (336). Advantageously, this structure provides an improved removable inner band (330), which is effective, economical, reliable and easy to use. Also, this construction helps to allow the plug portion (332) to remain in place, during use, and can slightly deflect or bend inwardly, to facilitate insertion and removal.

19 Claims, 5 Drawing Sheets

(56) References Cited

OTHER PUBLICATIONS

BlackDeath Over Ear Headphones, http://www.vibeaudio.co.uk/vibe-headphones/headphones-preview-pagel, Feb. 4, 2013, all pages.*

Motorola $11-Flex HD Wireless Stereo Bluetooth Headset—Retail Packaging—Black/White, http://nd3174.wordpress.com/2013/01/18/motorola-s11-flex-hd-wireless-stereo-bluetooth-headset-retail-packaging-blackwhitel, Feb. 4, 2013, all pages.*

* cited by examiner

AUGMENTED CUSTOM FIT HEADSET

BACKGROUND OF THE INVENTION

1. Field of the Disclosure

The disclosure relates in general to electronic communication devices and more particularly to an augmented custom fit headset.

2. Background Art

Current headsets have a stability issue, as they can shift and move about when undesired. Thus, there is a need to provide a mechanism that will provide additional stability, during normal use or while exercising.

It is therefore desirable to provide improved headsets that overcome this problem.

BRIEF DESCRIPTION OF THE DRAWINGS

In order to describe the manner in which the above-recited and other advantages and features of the disclosure can be obtained, a more particular description of the disclosure briefly described above will be rendered by reference to specific embodiments thereof which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

Figure 1:
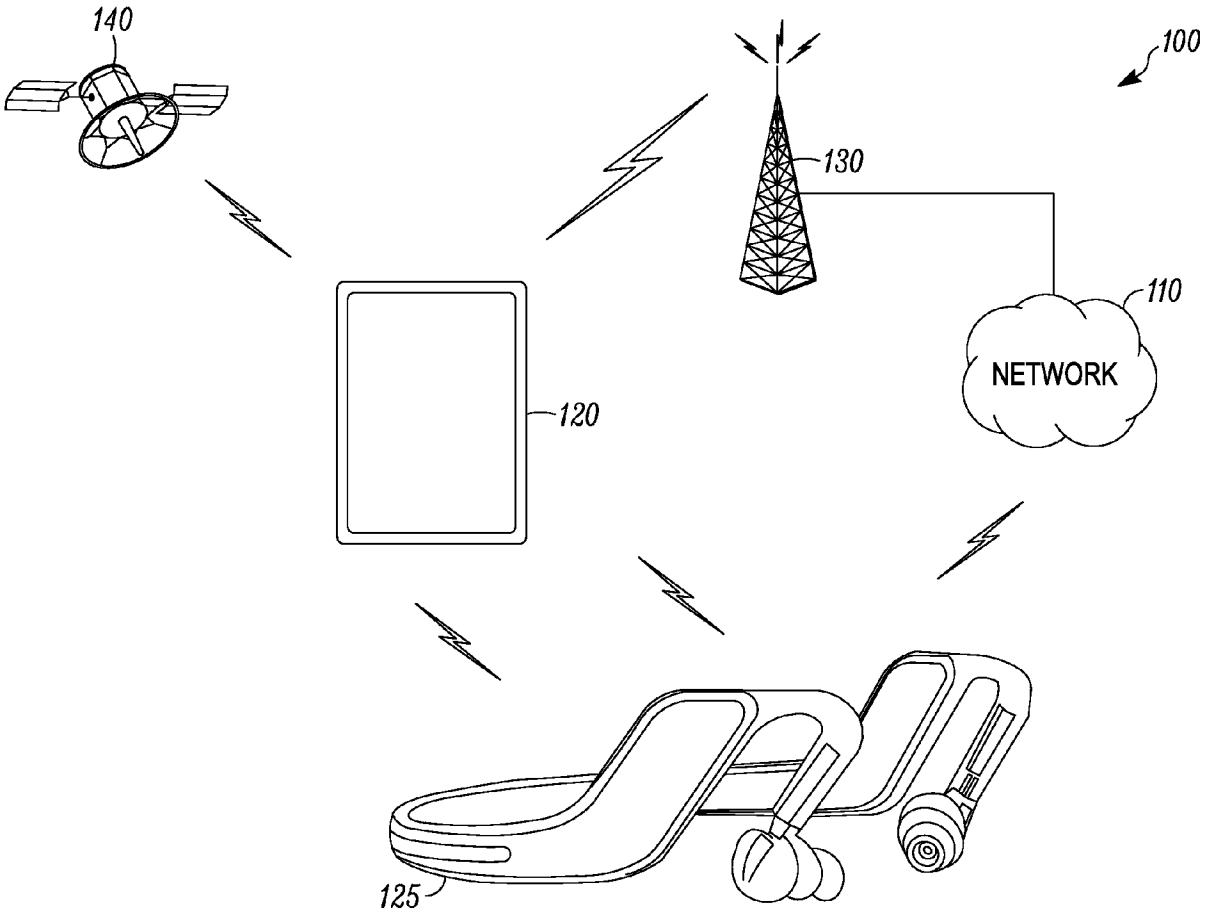
FIG. 1 is an exemplary block diagram of a communication system according to one embodiment.

FIG. 1 is an exemplary block diagram of a system 100 according to one embodiment. The system 100 can include a network 110, a terminal 120, and a base station 130. The terminal 120 may be a wireless communication device, such as a wireless telephone, a wearable device, a cellular telephone, a personal digital assistant, a pager, a personal computer, a tablet, a selective call receiver, or any other device that is capable of sending and receiving communication signals on a network including a wireless network. The network 110 may include any type of network that is capable of sending and receiving signals, such as wireless signals. For example, the network 110 may include a wireless telecommunications network, a cellular telephone network, a Time Division Multiple Access (TDMA) network, a Code Division Multiple Access (CDMA) network, Global System for Mobile Communications (GSM), a Third Generation (3G) network, a Fourth Generation (4G) network, a satellite communications network, and other like communications systems. More generally, network 110 may include a Wide Area Network (WAN), a Local Area Network (LAN) and/or a Personal Area Network (PAN). Furthermore, the network 110 may include more than one network and may include a plurality of different types of networks. Thus, the network 110 may include a plurality of data networks, a plurality of telecommunications networks, a combination of data and telecommunications networks and other like communication systems capable of sending and receiving communication signals. In operation, the terminal 120 can include a wireless communication device, which can communicate with the network 110 and with other devices on the network 110 by sending and receiving wireless signals via the base station 130, which may also comprise local area, and/or personal area access points, as detailed more fully herein. The terminal 120 can be in communication with an accessory, such as a headset 125. The terminal 120 is also shown being in communication with a global positioning system (GPS) 140 satellite, global navigation satellite system (GNSS) or the like, for location sensing and determination.

Figure 2:
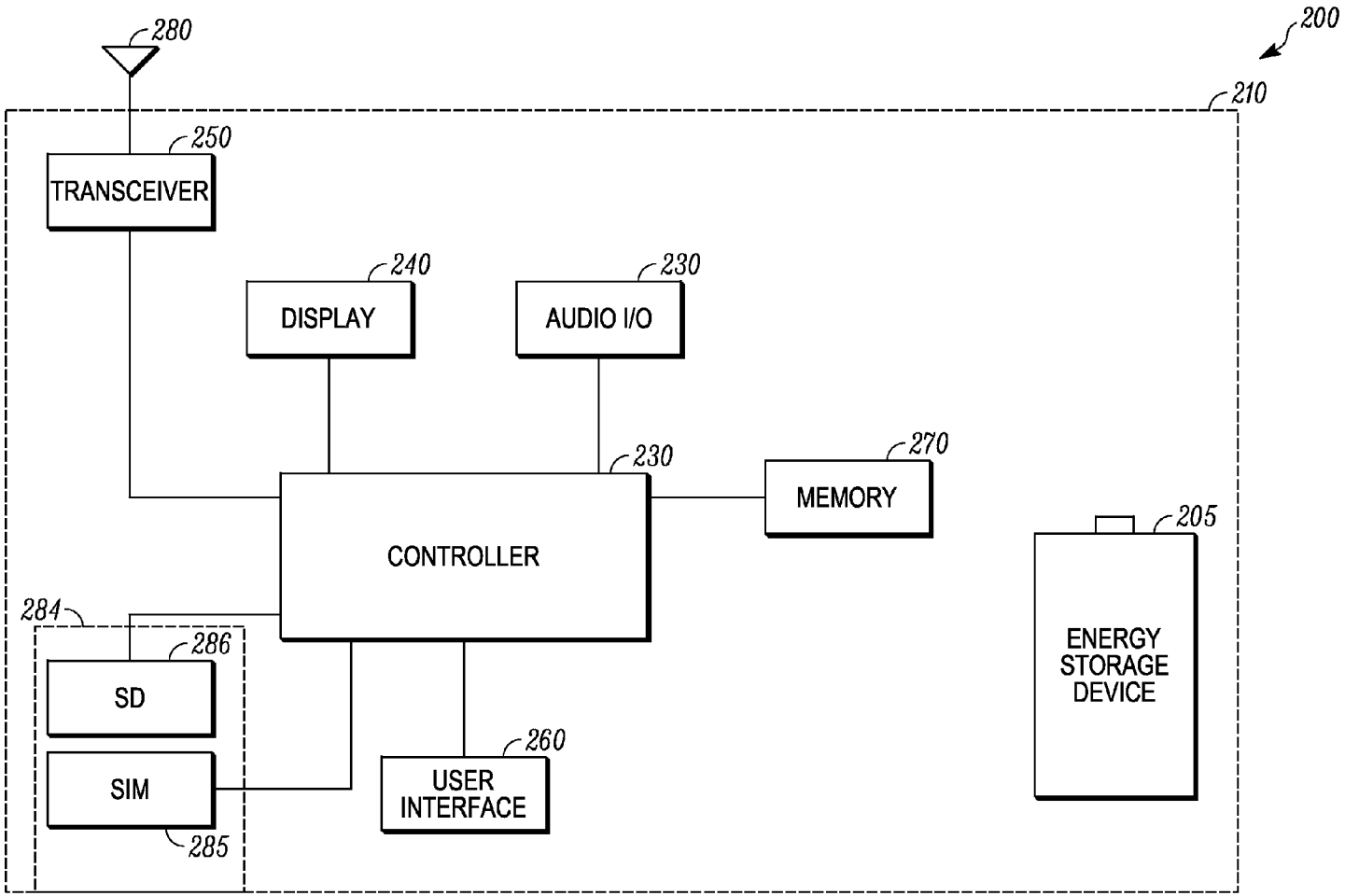
FIG. 2 is an exemplary block diagram of a wireless communication device suitable for use with an augmented headset according to one embodiment.

FIG. 2 is an exemplary block diagram of a wireless communication device 200 configured with an energy storage device, battery or module 205, such as in the terminal 120, for example. The wireless communication device 200 can include a housing 210, a controller 220 coupled to the housing 210, audio input and output circuitry 230 coupled to the housing 210, a display 240 coupled to the housing 210, a transceiver 250 coupled to the housing 210, a user interface 260 coupled to the housing 210, a memory 270 coupled to the housing 210, an antenna 280 coupled to the housing 210 and the transceiver 250, and an assembly 284 with data cards in the form of a SIM card 285 and SD card 286 coupled to the controller 220. In one embodiment, the transceiver 250 can include near field communications capabilities, such as Bluetooth, which is wirelessly couplable to the headset 300.

In another embodiment, the augmented headset 125 can be coupled to one of the other components in FIG. 1, or simply be a playback headset.

The display 240 can be a liquid crystal display (LCD), a light emitting diode (LED) display, a plasma display, a touch screen display or any other means for displaying information. The transceiver 250 may include a transmitter and/or a receiver. The audio input and output circuitry 230 can include a microphone, a speaker, a transducer, or any other audio input and output circuitry. The user interface 260 can include a keypad, buttons, a touch screen or pad, a joystick, an additional display, or any other device useful for providing an interface between a user and an electronic device.

The memory 270 may include a random access memory, a read only memory, an optical memory or any other memory that can be coupled to a wireless communication device.

Figure 3:
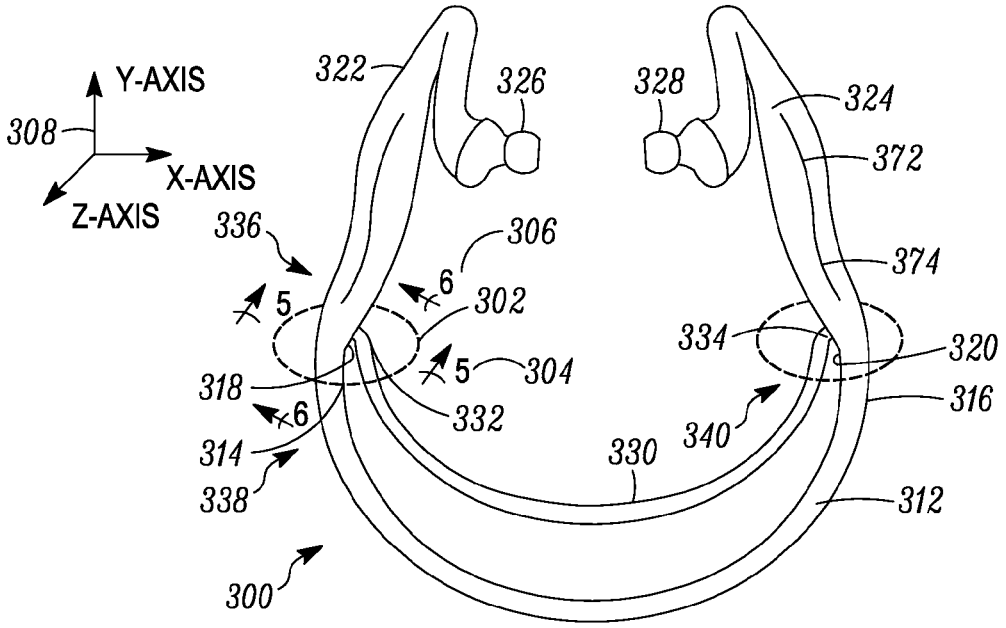
FIG. 3 is an exemplary top view of an augmented headset shown with a removable inner band including a dashed area 302 highlighting possible locations of a plug portion being snap connected to left and right end inner facing cavities of an outer band structure according to one embodiment.
Figure 4:
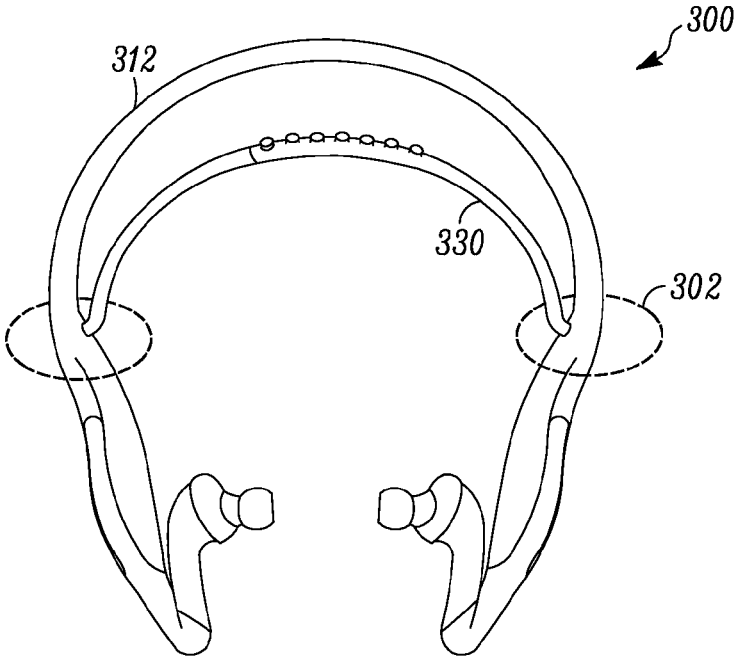
FIG. 4 is an exemplary top view of an augmented headset shown in FIG. 3, with an adjustable removable inner band according to one embodiment.

Referring to the FIGS. 3 and 4, an augmented custom fit headset 300 is shown. The augmented headset 300 can include: a wearable module 310 configured to be worn around a user's head including an outer band structure 312 with left and right ends 314 and 316, at least one of the left and right ends 314 and 316 having an inner facing cavity 318; earpiece modules 322 and 324 including left and right speakers 326 and 328 connected to the left and right ends 314 and 316; and a removable inner band 330 including a plug portion 332, the plug portion 332 being snap connected to the inner facing cavity 318, defining a snap connector 336.

Advantageously, this structure provides an augmented custom fit headset, with an improved removable inner band, which is effective, economical, reliable and easy to use. This construction helps to allow the plug portion 332 to remain in place, during use, and can slightly deflect or bend inwardly, for simplified insertion and removal.

As should be understood, the augmented custom fit headset 300, has many varying use cases. For example, the augmented headset 300 can be used with phones, MP3s, tablets, laptops. It can communicate with Bluetooth enabled devices that support the A2DP profile, as well as others.

The outer band structure 312 and removable inner band 330 can be made of a material to flex, to better fit a user's head.

FIG. 3 also includes dashed area 302, line 5-5 identified as 304, line 6-6 identified as line 306 and a compass 308 with an x, y and z axis.

Figure 8:
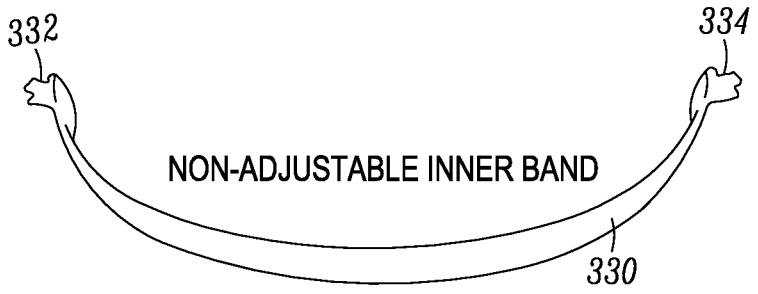
FIG. 8 is an exemplary perspective view of the removable inner band of the augmented headset shown in FIG. 3, according to one embodiment.
Figure 9:
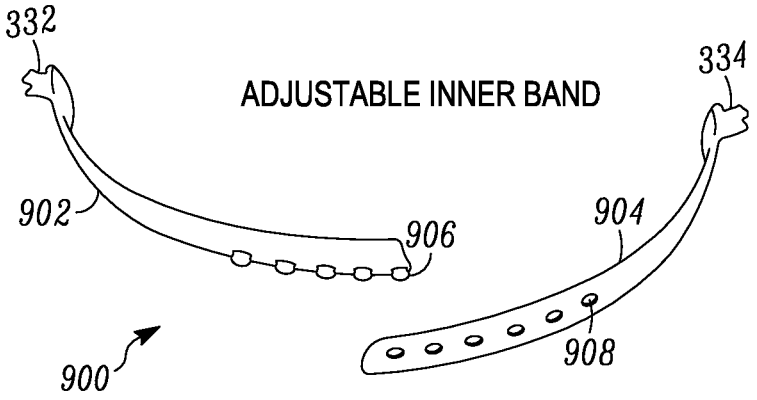
FIG. 9 is an exemplary perspective view of the adjustable removable inner band of the augmented headset shown in FIG. 4, according to one embodiment.

As shown in FIGS. 3, 8 and 9, the plug portion 332 extends outwardly from the wearable module 310 in a direction toward and is located in registration with the inner facing cavity 318, for simplified insertion and removal.

As shown in FIG. 3, the augmented headset 300 is generally "U" shaped, to securely fit around a rear of a user's head and ears. In one embodiment, the inner facing cavity 318 of the outer band structure 312 is complementarily configured to receive the plug portion 332 of the removable inner band 330.

The ear piece modules 322 and 324 are configured to fit around and sit on a user's ear. At least one of the ear piece modules 322 and 324, includes a control panel including a power control 372 and volume control 374, as shown in FIG. 3. In one embodiment, the earpiece modules 322 and 324 can include telescopic stem structure to fit various sized ears and have a rotating stem, to maintain the speakers in a user's ear canal. Ear cushions can be included for improved comfort and fit.

Figure 5:
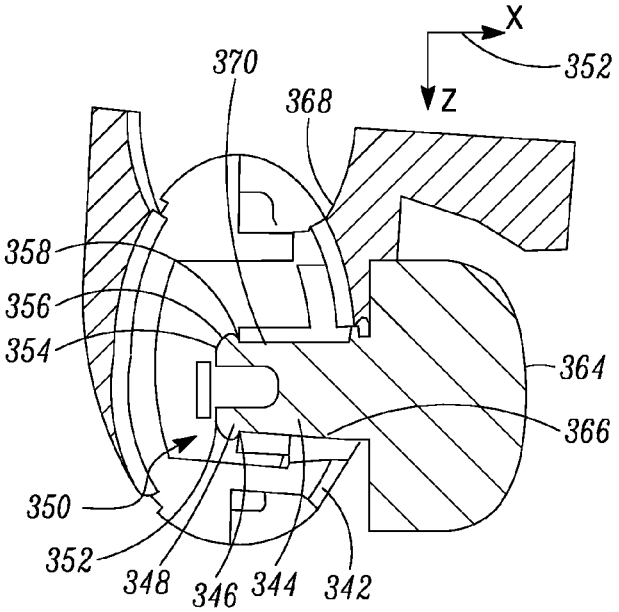
FIG. 5 is an exemplary partial cross sectional view along lines 5-5, of the augmented headset shown in FIG. 3, with the plug portion being snap connected to the inner facing cavity at the left end of the outer band structure, according to one embodiment.
Figure 6:
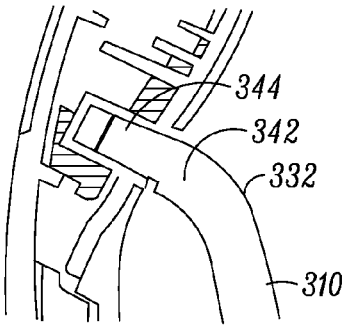
FIG. 6 is an exemplary partial cross sectional view along line 6-6, of the augmented headset shown in FIG. 3, with the plug portion shown snap connected to the inner facing cavity at the left end of the outer band structure, according to one embodiment.
Figure 7:
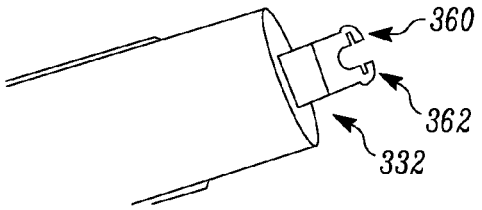
FIG. 7 is an enlarged exemplary perspective view of the plug portion of the augmented headset shown in FIG. 3, with a plug portion including a first probe and a second probe, providing a hook feature for enhanced snap connection to the inner facing cavity of the outer band and the probes can slightly bend and deflect during insertion or removal, according to one embodiment.

As shown in FIG. 5-7, the snap connector 336 is configured to enable a push mode for facilitating insertion and connection, a snap connection mode for enhanced locking and a pull mode for simplified removal. Advantageously, this can be enabled by the construction and geometry of the snap connectors 338 and 340, probes 360 and 362 and the appropriate material that is tough and flexible, for example.

The snap connector 336 in FIG. 3, can include a left snap connector 338 and a right snap connector 340, for enhanced and reliable connections to the left and right ends 314 and 316 of the outer band structure 312.

As best shown in FIGS. 5 and 7, the plug portion 332 includes a proximal section 342 and distal section 344, the distal section 344 including a first member 346 and a second member 348, defining a generally L shaped structure 350. In more detail in FIG. 5, the first member 346 can extend along an x axis of compass 352 and the second member 348 along a z axis, and the first member 346 can be longer than the second member 348.

As shown in FIG. 5, the second member 348 includes an outer surface 352 including a first section 354, a second section 356 and a third section 358. The first section 354 has an angle configured to assist and facilitate insertion and registration, defined as enabling a push mode. The second section 356 extends outwardly, as shown in FIG. 5 in a z direction, to maintain a snap connection and to minimize accidental or undesired disconnection. And, the third section 358 has an angle configured to facilitate a pull mode for simplified disconnection and/or removal. Advantageously, this structure provides an improved removable inner band, which is effective, economical, reliable and easy to use. This construction helps to allow the plug portion 332 to remain in place, during use, and can slightly deflect or bend inwardly, during insertion and removal.

As shown in FIG. 7, the snap connector 338 includes a plug portion 332 including a first probe 360 and a second probe 362, providing a fork structure for simplified connection and registration with a complementarily configured cavity, for example. This construction helps to allow the plug portion 332 to substantially remain in place, during use. And, during insertion and removal, the fork structure comprising the first and second probes 360 and 362, can slightly deflect or bend inwardly, Returning to the inner facing cavity 318 of the outer band structure 312, it can include a first rail section 364 and a second rail section 366 extending along an x axis, as shown in FIG. 5, from a proximal portion 368 to a distal portion 370 and being separated along a z axis length, sufficiently to provide a boundary around at least a portion of a plug portion 332. The first rail section 364 and the second rail section 366 terminate at a predetermined length along an x axis. The first and second member 346 and 348 extend past the termination, to provide a secure lock, when connected.

As shown in FIG. 6, the plug portion 332 can extend at an angle with respect to the left end 314 of the outer band structure 312. In one embodiment, the angle can range from about X to Y, for an improved interconnection and simplified registration.

The ear piece modules 322 and 324 are configured to fit around and sit on a user's ear. At least one of the ear piece modules 322 and 324, includes a control panel including a power control 372 and volume control 374, as shown in FIG. 3.

In one embodiment, as shown in FIG. 9, the removable inner band is adjustable 900, for an enhanced, secure and reliable fit. For example, the adjustable inner band 900 can include a left half 902 and right half 904 having plurality of male buttons 906 and female sections 908 configured to receive the buttons 906, respectively, for providing a plurality of enhanced secure connections.

Although embodiments have been shown and described, it is to be understood that various modifications, substitutions, and rearrangements of parts, components, and steps, as well as other uses can be made by those skilled in the art without departing from the novel spirit and scope of the invention.

What is claimed is:

1. An augmented custom fit headset, comprising:

a wearable module configured to be worn around a user's head including an outer band structure with left and right ends, at least one of the left and right ends having an inner facing cavity;

earpiece modules including left and right speakers connected to the left and right ends; and a removable inner band including a plug portion, the plug portion being snap connected to the inner facing cavity, defining a snap connector.

2. The headset in accordance with claim 1 wherein the inner facing cavity is complementarily configured to receive the plug portion of the removable inner band.

3. The headset in accordance with claim 1 wherein the snap connector is configured to enable a push mode, a snap connection mode and a pull mode.

4. The headset in accordance with claim 1 wherein the snap connector includes a left snap connector and a right snap connector.

5. The headset in accordance with claim 1 wherein the plug member includes a proximal section and distal section, the distal section including a first member and a second member being generally L shaped.

6. The headset in accordance with claim 5 wherein the first member extends along an x axis and the second member extends along a z axis.

7. The headset in accordance with claim 5 wherein the first member is longer than the second member.

8. The headset in accordance with claim 5 wherein the second member includes an outer surface including a first section, a second section and a third section.

9. The headset in accordance with claim 8 wherein the first section has an angle configured to facilitate a push mode.

10. The headset in accordance with claim 8 wherein the second section extends outwardly to maintain a snap connection.

11. The headset in accordance with claim 8 wherein the third section has an angle configured to facilitate a pull mode.

12. The headset in accordance with claim 1 wherein the snap connector includes a plug portion including a first probe and a second probe.

13. The headset in accordance with claim 1 wherein the receptacle includes a first rail section and a second rail section extending along an x axis from a proximal portion to a distal portion and being separated along a z axis sufficiently to provide a boundary around at least a portion of a plug portion.

14. The headset in accordance with claim 13 wherein the first rail section and the second rail section terminate at a predetermined length along an x axis.

15. The headset in accordance with claim 1 wherein the removable inner band is adjustable.

16. The headset in accordance with claim 1 wherein the plug portion extends outwardly from the wearable module in a direction toward and in registration with the inner facing cavity.

17. The headset in accordance with claim 1 wherein the ear piece modules are configured to fit around a user's ear.

18. An augmented custom fit headset, comprising:

a wearable module configured to be worn around a user's head including an outer band structure with left and right ends, at least one of the left and right having an inner facing cavity;

earpiece modules including left and right speakers connected to the left and right ends; and a removable inner band including a plug portion, the plug portion being snap connected to the inner facing cavity, defining a snap connector, the plug portion extends outwardly from the wearable module in a direction toward the inner facing cavity.

19. The headset in accordance with claim 18 wherein the ear piece modules are configured to fit around a user's ear.

* * * * *